United States Patent [19]

Grueter et al.

[11] Patent Number: 4,752,020

[45] Date of Patent: Jun. 21, 1988

[54] PRESSURIZED DISPENSING CONTAINER

[76] Inventors: Franz Grueter, 68 Middleton Ct., Smyrna, Ga. 30080; Peter Gebhardt, 3701 Valley Hill Rd., Kennesaw, Ga. 30144

[21] Appl. No.: 860,463

[22] Filed: May 7, 1986

[51] Int. Cl.[4] ..... B65D 83/00

[52] U.S. Cl. ..... 222/402.15; 222/402.11; 222/153; 222/182; 222/505

[58] Field of Search ..... 222/402.1, 402.13, 402.15, 222/402.12, 402.25, 402.11, 322, 151, 149, 153, 394, 402.21, 182, 505, 509; 137/630.22

[56] References Cited

U.S. PATENT DOCUMENTS

| | | | |
|---|---|---|---|
| 2,376,404 | 5/1945 | Thoms | 222/400 |
| 2,543,850 | 3/1951 | Henricson | 222/518 |
| 2,577,245 | 12/1951 | Tuttle et al. | 299/149 |
| 2,685,989 | 8/1954 | Samuels | 222/394 |
| 2,818,999 | 1/1958 | Miller | 222/323 |
| 2,868,419 | 1/1959 | Casey, Jr. | 222/394 |
| 2,895,650 | 7/1958 | Mahon et al. | 222/387 |
| 2,982,448 | 5/1961 | Leonard et al. | 222/153 |
| 2,994,461 | 8/1961 | Michel | 222/153 |
| 3,058,626 | 10/1962 | Hibbs et al. | 222/182 |
| 3,146,922 | 9/1964 | Tuttle, Jr. | 222/394 |
| 3,155,291 | 11/1964 | Wakeman | 222/394 |
| 3,169,672 | 2/1965 | Soffer et al. | 222/402.13 |
| 3,189,232 | 6/1965 | Joffe | 222/394 |
| 3,245,591 | 4/1966 | Kneusel et al. | 222/389 |
| 3,249,267 | 5/1966 | Carrion, Jr. et al. | 222/294 |
| 3,254,676 | 6/1966 | Beard, Jr. | 137/630.22 |
| 3,254,677 | 6/1966 | Wakeman | 137/630.22 |
| 3,255,936 | 6/1966 | Healy et al. | 222/389 |
| 3,318,492 | 5/1967 | Haas | 222/402.11 |
| 3,323,695 | 6/1967 | Monahon | 222/506 |
| 3,361,301 | 1/1968 | Meshberg | 222/149 |
| 3,415,426 | 12/1968 | Kleveland | 222/402.12 |
| 3,422,996 | 1/1969 | Lipman | 222/402.11 |
| 3,469,746 | 9/1969 | Me Locchi | 222/400.12 |
| 3,484,023 | 12/1969 | Meshberg | 222/402.11 |
| 3,510,029 | 5/1970 | Doyle | 222/402.12 |
| 3,515,316 | 6/1970 | Green | 222/207 |
| 3,583,607 | 6/1971 | Beck | 222/402.21 |
| 3,584,789 | 6/1971 | Traynor | 222/149 |
| 3,618,827 | 11/1971 | Me Locchi | 222/182 |
| 3,642,179 | 2/1972 | Micallef | 222/402.12 |
| 3,648,905 | 3/1972 | Kauder | 222/402.21 |
| 3,698,604 | 10/1972 | Nigro | 222/182 |
| 3,712,517 | 1/1973 | Davenport | 222/402.13 |
| 3,991,916 | 11/1976 | Del Bon | 222/402.13 |
| 4,056,213 | 11/1977 | Stern | 222/402.12 |
| 4,068,782 | 1/1978 | Van der Heijden | 222/402.13 |
| 4,249,678 | 2/1981 | Pombo | 222/149 |
| 4,252,455 | 2/1981 | De la Pena | 401/190 |
| 4,278,187 | 7/1981 | Luedtke | 222/153 |
| 4,347,980 | 9/1982 | Seki | 239/289 |
| 4,526,456 | 6/1985 | Livingston | 222/149 |

FOREIGN PATENT DOCUMENTS

| | | | |
|---|---|---|---|
| 2308417 | 12/1976 | France | 222/402.15 |

*Primary Examiner*—Joseph J. Rolla
*Assistant Examiner*—Kenneth Noland
*Attorney, Agent, or Firm*—Antonelli, Terry & Wands

[57] ABSTRACT

A pressurized dispensing container for viscous and liquid materials comprises an outer container body, an inner container body and a container closure member secured on both the inner and outer container bodies. A container valve is located on the closure member for dispensing material from the container. A cap provided on the container has a discharge opening therein. The container valve is formed with and integral valve spout which extends from the container valve to the cap and which carries a discharge opening valve for opening and closing the discharge opening of the cap. An actuator lever arm for actuating the container valve is formed integrally with the container closure member to permit actuating the container valve. A locking mechanism for the container comprises a resilient tab which is provided on the cap for selective cooperation with an actuator button carried by the actuator lever arm to releasably lock the button against movement to prevent actuation of the container valve.

15 Claims, 3 Drawing Sheets

PRESSURIZED DISPENSING CONTAINER

BACKGROUND AND SUMMARY OF THE INVENTION

The present invention is directed to an improved pressure dispensing container for viscous and liquid materials. In particular, the pressurized dispensing container is useful for dispensing products such as shaving gels, caulks, waxes, hand cleaners, toothpaste and other products maintained under pressure in the container.

An object of the invention is to provide an improved pressurized dispensing container which hermetically closes the discharge opening in a cap provided on the container to prevent contamination of the material within the discharge opening and air hardening thereof from exposure to the atmosphere when the container is not in use. Another object of the invention is to provide an improved pressurized dispensing container wherein the cover on the container can be permanently secured to the container to form a completely integrated pressurized dispensing container, for use with viscous and liquid products wherein the product is dispensed with one-finger pressure and there is no need for a removable cap on the container.

An additional object of the invention is to provide an improved pressurized dispensing container wherein the actuating mechanism can be locked to prevent accidental discharge of material from the container. A still further object of the invention is to provide an improved pressurized dispensing container formed of a minimum number of parts for simplicity, ease of manufacturing and relatively low cost.

These and other objects of the invention are attained by providing a pressurized dispensing container for viscous and liquid materials comprising a container, a container valve located on the container for dispensing material from the container, a cap located on the container and having a discharge opening therein, means defining a discharge duct between the container and the discharge opening of the cap, a discharge opening valve for opening and closing the discharge opening of the cap, means for actuating the container valve, and means for actuating the discharge opening valve in response to actuation of the container valve, and wherein the means for actuating the container valve is formed integrally with the container.

According to an additional feature of the invention, the means defining the discharge duct includes a valve spout formed integrally with the container valve which extends from the container valve to the cap. The discharge opening valve is connected to an outer end of the valve spout. In a disclosed, preferred embodiment, the discharge opening valve is formed integrally with the valve spout of the container valve.

The pressurized dispensing container of the invention also preferably includes a locking mechanism with is selectively actuable for preventing actuation of the container valve. In the disclosed embodiment, the means for actuating the container valve includes an actuator lever arm with an actuator button at one end thereof which is adapted to be moved to actuate the container valve. The actuator button extends through an opening therefor provided in the outer surface of the cap. The locking mechanism includes a locking member formed on the cap and movable between a first position where the locking member engages the actuator button in a manner to prevent movement of the actuator button and a second position where it permits the actuator button to be moved to actuate the container valve. The locking member is in the form of a resilient tab having one of a projection and a complimentarily shaped recess which cooperates with the other of the projection and the complimentarily shaped recess which is provided on the actuator button. The projection is received in the recess in the first position for preventing movement of the actuator button and actuation of the container valve.

In the disclosed embodiment the pressurized dispensing container comprises an outer container body, a closure member in the form of a container top which is secured to the outer container body, and an inner container body containing the material to be dispensed. The inner container body is located within the outer container body and is sealed to the container closure member. A pressurized fluid is provided in the container between the inner and outer container bodies. The inner container body is formed of a thin flexible material, so that it will be collapsed under the fluid pressure of the pressurized fluid to forceably dispense material from the container when the container valve is actuated.

The outer container body is formed with an outwardly extending flange and the closure member has an outwardly extending flange extending about and fixedly secured to the flange of the outer container body with the material of the inner container body extending between the flanges and being sealingly connected to both of the flanges.

These and other objects, features and advantages of the present invention will become apparent from the following description when taken in connection with the accompanying drawings which show, for purposes of illustration only, one embodiment in accordance with the present invention.

DETAILED DESCRIPTION OF THE DISCLOSED EMBODIMENT

Figure 2:
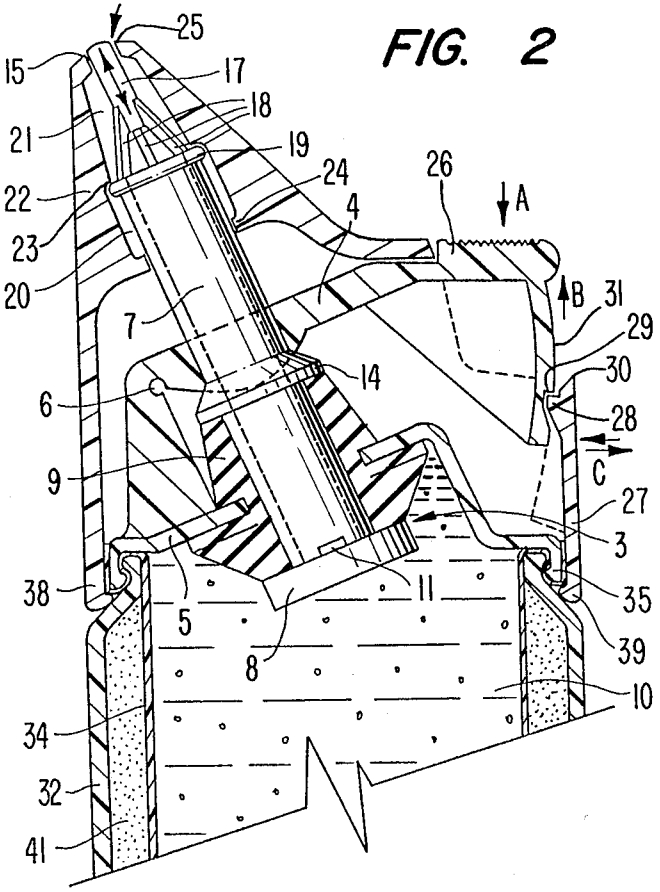
FIG. 2 is a side elevational view, partially in cross-section, of the upper portion of the pressurized dispensing container shown in FIG. 1 taken along the line II—II.
Figure 1:
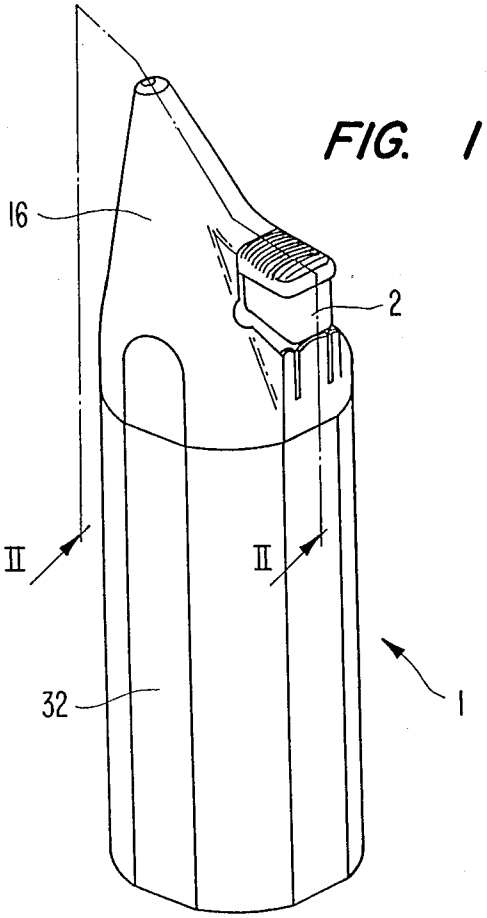
FIG. 1 is a perspective view from one side and slightly above a pressurized dispensing container according to a preferred embodiment of the invention.

Referring now to the drawings, a pressurized dispensing container 1 according to the invention is a completely integrated container adapted to be used with viscous and liquid products such as shaving gels, caulks, waxes, hand cleaners, toothpaste and the like. The product is maintained under pressure in the container and is adapted to be dispensed from the container 1 by application of one-finger pressure on an actuator button 2 of the container in the direction of arrow A as shown in FIG. 2. The downward movement of the actuator button 2 in the direction of arrow A opens a container valve 3 by means of a second class lever action of an actuator lever arm 4 on the valve 3. The actuator lever arm 4 is formed integrally with the actuator button 2 at its free end and a container closure member in the form of container top 5 at its other end. An annular cut out 6 permits the actuator lever arm 4 to pivot relative to the remainder of the container top 5 when the actuator button 2 is depressed or moved upwardly from a depressed position upon release of the actuator button.

The container valve 3, shown partially in cross-section in its closed position in FIG. 2, is actuated to open the valve when the button 2 is depressed so that the lever arm 4 presses downwardly on a valve spout 7 of the valve in a direction along the axis of the valve spout. The valve spout 7 can be formed of a molded plastic material, for example. With downward movement of spout 7, a flange 8 at the lower end of the valve spout 7 moves away from the lower end of a resilient gasket 9 of the valve which is formed of rubber, for example. Product 10 under pressure within the container then moves through small orifices 11 in the lower end of the valve spout 7 adjacent the flange 8 and outwardly through the central passage 12 in the valve spout. The resilient gasket is located within an opening 13 in the container top 5 and provides a seal between the top 5, valve spout 7 and flange 8 to close the container except when the valve spout is depressed downwardly by the actuator lever arm 4. Upon release of the actuator button 2, the resilient nature of the gasket 9 causes the valve spout 7, adjacent actuator lever arm 4 and the actuator button 2 to move upwardly, thereby closing the valve 3 as the lower end of the gasket seals against the flange 8 and lower end of the valve spout 7. The upper end of the resilient gasket 9 and an intermediate, rounded lower surface of the actuator lever arm 4 act upon each other through an intermediate flange 14 of the valve spout. The container top 5 with integral actuator lever arm 4 and actuator button 2 can be formed of a plastic material such as PET plastic or similar material by molding, for example.

Liquid or viscous product 10 forced upwardly through the valve spout 7 upon opening of the container valve 3 is dispensed through a discharge opening 15 in a cap 16 located on the top of the container. A tip seal valve 17 in the form of a movable plug is connected to the valve spout 7 by a number of, 2–4, valve stems 18 as shown in FIG. 2. The valve 17 and valve stems 18 can be integrally molded with the valve spout 7 of the container valve 3 or formed separately and connected thereto as by bonding, for example. A shoulder 19 is provided about the outer periphery of the upper end of the valve spout 7 for cooperating with an enlarged portion of a bore 21 formed in the cap 16 to guide the valve spout 7 and valve 17 thereon during movement of the valve spout in response to actuation of the container valve 3. The movement of the valve 17 and the valve spout 7 in the bore 21 of the tip portion 22 of the cap 16 is limited in both directions of movement by the reduced diameter portions 23 and 24 on the respective sides of the enlarged diameter portion 20 receiving the shoulder 19. When the container valve 3 is closed, the valve spout 7 and tip seal valve 17 carried thereby are moved to their upper position as shown in FIG. 2 where the tip of the valve 17 cooperates with the wall 25 defining the discharge opening 15 in the wall of the cap 16 to hermetically close the discharge opening 15 of the cap 16. That is, the valve 17 is a movable plug which forms a tip seal with the wall 25 to close the discharge opening 15. This prevents contamination and air hardening of the material within the discharge opening and discharge passage above the container valve 3 when the container is not in use.

Actuation of the container valve 3 in the manner described above causes the valve 3, that is, both the valve spout 7 and the upper portion of the resilient gasket 9 to move downwardly, and allows the product 10 within the container to move upwardly through the central passage 12 in the valve spout 7. Because the valve spout 7 is connected to the tip seal valve 17 by way of the three valve stems 18, the valve 17 moves integrally with the valve 3 away from the wall 25 of the discharge opening 15 to open the discharge opening. As a result, material within the container 1 which has been dispensed through the valve 3 upon actuation thereof can be conveyed through the valve spout 7 and bore 21 and dispensed from the discharge opening 15. Upon release of the actuator button 2, the valve 3 closes itself because of the resilience of the rubber gasket 9 therein, thereby restoring the vertical position of the valve 3 as it returns to its original position. As this happens, the valve spout 7 and valve stems 18 move the tip seal valve 17 thereon, so that the valve 17 cooperates with the wall 25 to hermetically close the discharge opening 15.

The cover cap 16 of the container is made of low density polyethylene or similar material as by molding. In addition to the discharge opening 15 with wall 25, bore 21 and enlarged portion 20 thereof formed in the tip portion 22 of the cap 16, the cap is also formed with an opening 26 through which the actuator button 2 protrudes and a locking means selectively actuable for preventing actuation of the container valve 3. In particular, the locking means of the cap 16 includes a locking member in the form of a resilient tab 27 formed integrally with the cap. The tab 27 has a projection 28 formed on its side facing the actuator button as shown in FIG. 2. A complimentary shaped recess 29 is formed in the radially outwardly facing side wall of the actuator button 2 for receiving the projection 28. The actuator button 2 is locked by moving the button upwardly in the direction of arrow B in FIG. 2, until the projection 28 on resilient tab 27 snaps into the recess 29 in the button as shown in FIG. 2. In this position, the tab 27 and projection 28 formed thereon cooperate to prevent downward movement of the actuator button 2 in the direction of arrow A. Thus, the container 1 can be readily locked to prevent accidental discharge of material from the container as, for example, when the container is packed in a suitcase or otherwise accidentally bumped. To unlock the container, a person grasps the top edge 30 of the resilient tab 27 with a finger or fingernail and pulls it outwardly in the direction of arrow C in FIG. 2 to move the projection 28 out of the recess 29 of the button. This allows the button 2 and actuator lever arm 4 to move downwardly slightly until the lever arm engages the flange 14 on the valve spout 7. The top 5 with arm 4 can be formed so that the lever arm tends to resiliently return to this unlocked position from the locked position as shown in FIG. 2. In the unlocked position the projection 28 on the tab 27 merely contacts the smooth side wall 31 of the actuator button 2 above the recess 29 so that the projection 28 slides relative to the actuator button and does not stop the downward movement of the actuator button A in the direction of arrow A. The resilient tab 27 and projection 28 are formed integrally with the cap 16, so that no additional parts are required for the locking mechanism of the container. Further, since the actuator button 2 and the actuator lever arm 4 are formed integrally with the container top 5, the container 1 of the invention has a minimum number of parts thereby simplifying manufacturing and assembly and lowering the costs thereof.

Figure 3:
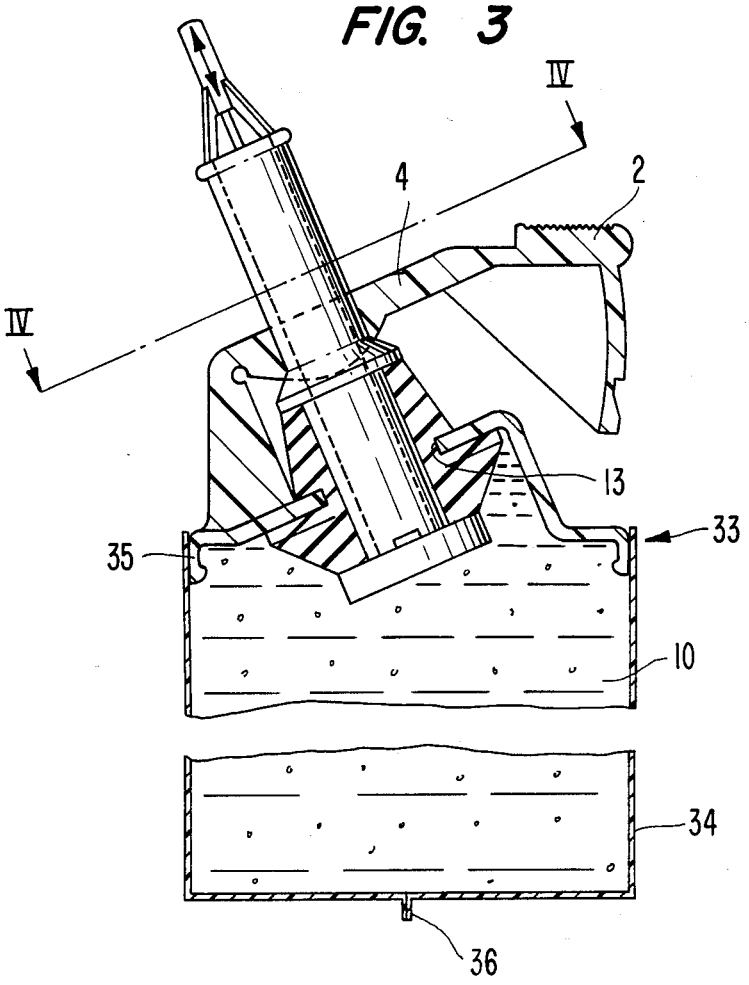
FIG. 3 is a side elevational view, partially in cross-section, of a sub-assembly of the container of FIGS. 1 and 2 showing the inner container body attached to the container top having a valve located therein and an integral actuator lever arm with actuator button.

The pressurized dispensing container 1 shown in the illustrated embodiment is a completely integrated pressurized dispensing container formed of an outer container body 32 made of PET plastic or similar material, a container top 5 and an inner container body 34. During assembly or manufacturing of the container 1, a sub-assembly 33 as shown in FIG. 3 is formed of the inner container body 34 which is joined at its upper end to the outer peripheral surface of a lower depending flange 35 of the container top 5 by means of bonding as by fusion or adhesive bonding. The product to be stored in and dispensed from the container 1 is then introduced into the lower end of the container body 34 which is thereafter closed at 36 to effectively seal the product 10 within the inner container body 34. The inner container body 34 has a flexible side wall formed of a laminate of plastic and aluminum foil, for example. The particular materials of the inner container body, of course, depend upon the specific product to be stored within the container.

The filled sub-assembly 33 is placed within the outer container body 32 and the joined thereto. In particular, the open top of the outer container body 32 is provided with a flange 37 thereon which can be snapped within the lower depending flange 35 of the container top 5 with the material of the inner container body 34 extending therebetween as shown in FIG. 2. Before placing the sub-assembly 33 within the outer container body 32, a liquified gas or other pressurizing agent 41 is placed within the outer container body for applying pressure to the inner container body 34 when the sub-assembly is joined to the outer container body. After the inner container body is slipped into the outer container body, such that the flanges 35 and 37 cooperate in the aforementioned matter, the outer container body is sealed to the inner container body 34 as by fusion with induction heating or by adhesive bonding, for example, to form a fluid pressure tight seal to retain the pressurizing medium in the space between the inner and outer container bodies. The mechanical pressure of the fit of the flange 37 within the flange 35 with the inner container body therebetween, could also be employed to effectively seal the outer container body.

The lower flange 38 of the cap 16 is also formed with an inwardly directed protrusion 39 thereon. The cap 16 is dimensioned so that the flange 38 with protrusion 39 can be snapped over the outer peripheral portion of the container top 5 as shown in FIG. 2 to securely retain the cap 16 on the container. Bonding can also be employed in addition to the mechanical interfit for securing the cap on the container, if desired. The cap 16 can be attached to the container top after the top 5 is joined to the upper end of the inner container body 34 as shown in FIG. 3 and prior to filling of the inner container body and closure thereof at 36. Alternatively, cap 16 can be attached to the sub-assembly 33 after the inner container body 34 has been filled with the product 10 and sealed at 36. It is also possible to attach the cap 16 as a final step after the inner container body 34 has been placed within and joined to the outer container body 32 as discussed above. Accidental dispensing of product 10 during assembly of the cap 16 thereon, can be avoided by attaching the cap to the container top 5 before the inner container body is filled with product 10 or at least before the pressurizing medium between the inner and outer container bodies acts upon the inner container body with sufficient pressure to force material out of the inner container body upon opening of the container valve 3.

Figure 4:
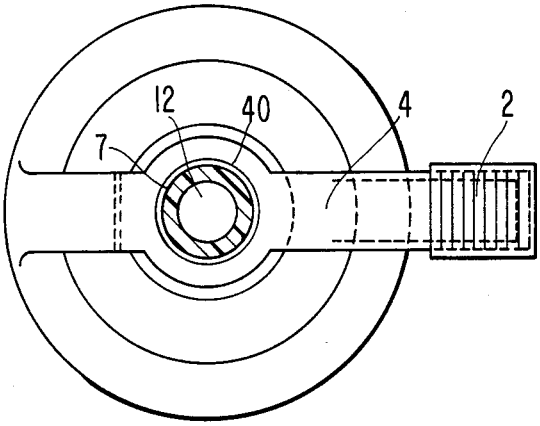
FIG. 4 is a sectional view of the container sub-assembly of FIG. 3 taken along the line IV—IV.
Figure 5:
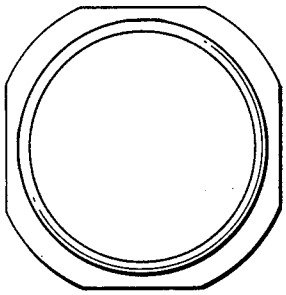
FIG. 5 is a top view of the outer container body to which the sub-assembly of FIGS. 3 and 4 is attached.
Figure 7:
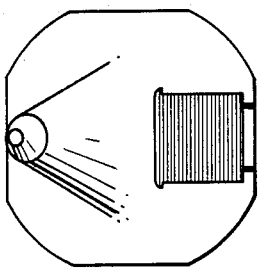
FIG. 7 is a top view of the pressurized dispensing container shown in FIG. 1.
Figure 6:
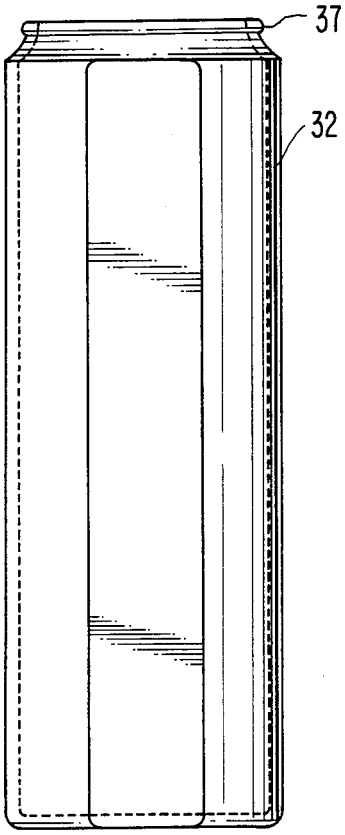
FIG. 6 is a front side elevational view of the outer container body shown in FIG. 5.
Figure 8:
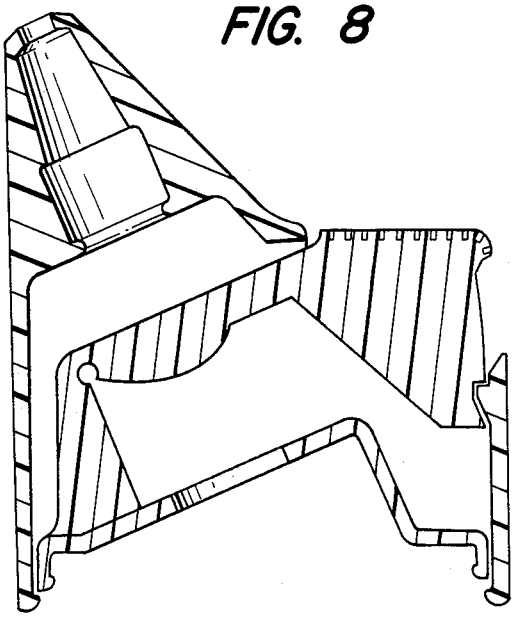
FIG. 8 is an enlarged side elevational view of the actuator button and locking member therefor as shown in FIG. 1.

The container valve 3 is joined to the container top 5 prior to filling the inner container body with product 10. The actuator lever arm is formed with an opening 40 as shown in FIG. 4 which receives the valve spout 7. The cap 16 has sufficient resilience that the shoulder 19 on the spout 7 can be inserted into the enlarged portion 21 of the bore 20 during mounting of the cap on the container.

We claim:

1. A pressurized dispensing container for viscous and liquid materials, comprising an outer container body, a closure member for said container body in the form of a container top which is secured to the outer container body, container valve means located in said container top for dispensing material from said container, a cap located on said container over said container top, said cap having a discharge opening therein, means defining a discharge duct between said container top and said discharge opening of said cap, discharge opening valve means for opening and closing said discharge opening of said cap, means for actuating said container valve means, means for actuating said discharge opening valve means in response to actuation of said container valve means and wherein said means for actuating said container valve means includes an actuator lever arm having one free end which when pressed opens said container valve means and an opposite end which is formed integrally with said container top adjacent said container valve means, and wherein an intermediate portion of said actuator lever arm presses said container valve means to open said container valve means when said one free end of the lever arm is pressed by a second class lever action of said actuator lever arm.

2. A pressurized dispensing container according to claim 1, wherein said means defining a discharge duct includes a valve spout of said container valve means which extends from said container top to said cap.

3. A pressurized dispensing container according to claim 2, wherein said discharge opening valve means is connected to an outer end of said valve spout.

4. A pressurized dispensing container according to claim 3, wherein said discharge opening valve means is formed integrally with said valve spout of said container valve means.

5. A pressurized dispensing container according to claim 1, further comprising locking means selectively actuable for preventing actuation of said container valve means.

6. A pressurized dispensing container according to claim 5, wherein said actuator lever arm includes an actuator button at said one free end thereof which is adapted to be moved to actuate said container valve means, said actuator button extending through an opening therefor provided in the outer surface of said cap and wherein said locking means includes a locking member formed on said cap and movable between a first position where said locking member engages said actuator button in a manner to prevent movement of said actuator button and a second position where said locking member permits said actuator button to be moved to actuate said container valve means.

7. A pressurized dispensing container according to claim 6, wherein said locking member is in the form of a resilient tab having one of a projection and a complimentarily shaped recess for cooperation with the other of said projection and said complimentarily shaped recess which is provided on said actuator button, said projection being received in said recess for preventing movement of said actuator button and actuation of said container valve means.

8. A pressurized dispensing container according to claim 1, wherein said container further comprises an inner container body container a material to be dispensed and located within said outer container body and being sealed to said container top.

9. A pressurized dispensing container according to claim 8, wherein a pressurized fluid is provided in said container between said outer container body and said inner container body.

10. A pressurized dispensing container according to claim 9, wherein said inner container body is formed of a thin flexible material, so that said inner container body can be collapsed under the pressure of said pressurized fluid to forceably dispense material from said container when said container valve means is actuated.

11. A pressurized dispensing container according to claim 10, wherein said outer container body has an outwardly extending flange and said container top has an outwardly extending flange extending about and fixedly secured to said flange of said outer container body with said inner container body extending between said flanges.

12. A pressurized dispensing container for viscous and liquid materials, comprising a container, container valve means located on said container for dispensing material from said container, a cap located on said container, said cap having a discharge opening therein, means defining a discharge duct between said container and said discharge opening of said cap, discharge opening valve means for opening and closing said discharge opening of said cap, means for actuating said container valve means, means for actuating said discharge opening valve means in response to actuation of said container valve means, and locking means selectively actuable for preventing actuation of said container valve means, wherein said means for actuating said container valve means includes an actuator lever arm with an actuator button at one end thereof which is adapted to be moved to actuate said container valve means, said actuator button extending through an opening therefor provided in the outer surface of said cap, and wherein said locking means includes a locking member formed on said cap and movable between a first position where said locking member engages said actuator button in a manner to prevent movement of said actuator button and a second position where it permits said actuator button, to be moved to actuate said container valve means.

13. A pressurized dispensing container according to claim 12, wherein said locking member is in the form of a resilient tab having one of a projection and a complimentarily shaped recess for cooperation with the other of said projection and said complimentarily shaped recess which is provided on said actuator button, said projection being received in said recess in said first position of said locking member for preventing movement of said actuator button and actuation of said container valve means.

14. A pressurized dispensing container for viscous and liquid materials, comprising container means for containing a material to be dispensed, container value means located in said container means for dispensing material from said containing means, a cap located on said container means, said cap having a discharge opening therein, means defining a discharge duct between said container means and said discharge opening of said cap, discharge opening valve means for opening and closing said discharge opening of said cap, means for actuating said container valve means, means for actuating said discharge opening valve means in response to actuation of said container valve means, and locking means selectively actuable for preventing actuation of said container valve means, wherein said means for actuating said container valve means includes an actuator lever arm with an actuator button at one end thereof which is adapted to be moved to actuate said container valve means, said actuator button extending within an opening therefor provided in the outer surface of said cap, and wherein said locking means is provided on said cap and is movable between a first position where said locking means prevents movement of said actuator button to actuate said container valve means and a second position where said locking means permits said actuator button to be moved to actuate said container valve means.

15. A pressurized dispensing container according to claim 14, wherein said actuator button is formed integrally with said actuator lever arm.

* * * * *